US006725943B2

(12) United States Patent
Ginell

(10) Patent No.: US 6,725,943 B2
(45) Date of Patent: Apr. 27, 2004

(54) TARGET TORQUE DETECTION AT POWER WRENCHES HAVING MECHANICAL RELEASE CLUTCH

(75) Inventor: Thomas Klas Ginell, Haägersten (SE)

(73) Assignee: Atlas Copco Tools AB, Nacka (SE)

( * ) Notice: Subject to any disclaimer, the term of this patent is extended or adjusted under 35 U.S.C. 154(b) by 0 days.

(21) Appl. No.: 10/188,126

(22) Filed: Jul. 1, 2002

(65) Prior Publication Data

US 2003/0006049 A1 Jan. 9, 2003

(30) Foreign Application Priority Data

Jul. 6, 2001 (SE) ..... 0102428

(51) Int. Cl.[7] ..... E21B 7/00
(52) U.S. Cl. ..... 173/1; 173/217; 192/150
(58) Field of Search ..... 173/1, 176, 178, 173/180, 181, 216, 217; 192/56.4, 150

(56) References Cited

U.S. PATENT DOCUMENTS 4,019,589 A * 4/1977 Wallace ..... 173/178
4,154,308 A * 5/1979 Goldsberry et al. ..... 173/178
4,554,980 A * 11/1985 Doniwa ..... 173/176
4,880,064 A * 11/1989 Willoughby et al. ..... 173/178
4,881,435 A * 11/1989 Hansson ..... 81/469
5,004,054 A * 4/1991 Sheen ..... 173/178
5,060,771 A * 10/1991 Robinson ..... 477/178
5,156,244 A * 10/1992 Pyles et al. ..... 477/178
5,201,374 A 4/1993 Rahm
5,289,885 A * 3/1994 Sakoh ..... 173/2
5,569,118 A * 10/1996 Holmin ..... 477/178
5,868,208 A 2/1999 Peisert et al.
6,155,355 A * 12/2000 Holmin ..... 173/176

* cited by examiner

*Primary Examiner*—Scott A. Smith
*Assistant Examiner*—Nathaniel Chukwurah
(74) *Attorney, Agent, or Firm*—Frishauf, Holtz, Goodman & Chick, P.C.

(57) ABSTRACT

A method and a power wrench for detecting the attainment of a target torque level in a screw joint tightening process, wherein an override type torque responsive release clutch (17) is used in the power wrench for defining the target torque level, comprising a microphone (22) mounted in the power wrench for recording the "click" sound developed in the clutch (17) during the release movement, and a control unit (20) including motor operation governing means, and a signal identifying device is connected to the microphone (22) for recognizing the release "click" sound and delivering a stop signal for interrupting the power supply to and braking the power wrench motor (15) as the clutch (17) has released and the target torque level is reached.

4 Claims, 1 Drawing Sheet

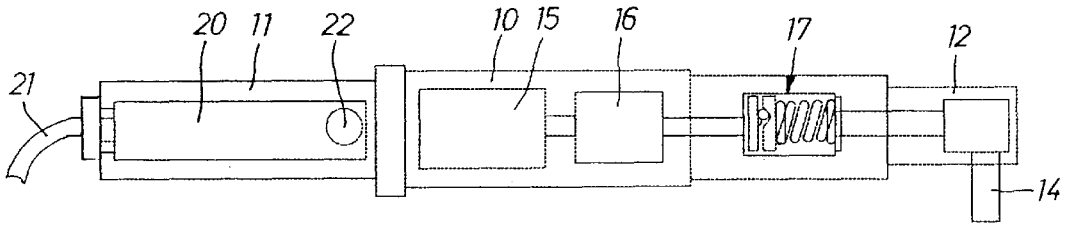
20
11
22
10
15
16
17
12
21
14

TARGET TORQUE DETECTION AT POWER WRENCHES HAVING MECHANICAL RELEASE CLUTCH

BACKGROUND OF THE INVENTION

Target torque detection at power wrenches having mechanical release clutch.

The invention relates to a method for detecting the attainment of a predetermined target torque level when tightening screw joints by means of a power wrench having a mechanical override type release clutch, and a power wrench including that type of clutch as well as means for detecting the release of the clutch and, hence, the attainment of the predetermined target torque level.

In one type of prior art power wrenches, as shown for instance in U.S. Pat. No. 5,201,374, a predetermined release torque level is detected by a mechanical device connected to one of the clutch halves for transferring a release movement to a power shut-off device. This mechanical type of target torque detection suffers from the drawback of an undesirable mechanical influence on the clutch operation in that the release torque level to some extent is dependent on the frictional resistance in the release detecting mechanism.

In another type of prior art wrenches, as shown in for instance U.S. Pat. No. 5,868,208, the attainment of a predetermined target torque level is indicated by a micro switch indicating a release movement of one of the clutch parts. The switch is usually connected to an electric control unit for initiating power shut-off as a clutch release is indicated. This type of clutch release sensing device is disadvantageous in that it is exposed to a mechanical wear thereby having a limited service life.

In still another type of prior art wrenches the clutch release is indicated by a Hall-element located close to the clutch for detecting the release movement of one part of the clutch and delivering an electric signal in response thereto. This type of release detection, however, requires a specific clutch design providing an extended or amplified release movement for ensuring a proper activation of the Hall-element.

OBJECT OF THE INVENTION

In order to avoid the problems and drawbacks of the above described previous devices for detecting the target torque level and clutch release point the invention provides a technique which does not have any influence mechanically or otherwise on the release movement of the clutch and which requires very little space and which does not require any special clutch design.

A general object of the invention is to provide a technique where the actual release of the clutch is detected. This is in contrast to most other methods where the change in position of a moving part of the clutch is detected, which might not correctly reflect the fact that the clutch has actually released. Especially at low output shaft rotation speed the inertia of the motor and gear mechanism might not be enough to ensure clutch release after a specific position for the clutch has been detected.

So, the main object of the invention is to provide a method and a power wrench where the attainment of a predetermined target torque is detected as a release sound of a torque responsive release clutch of the override type comprised in the power wrench.

Further objects of the invention will appear from the following specification and claims.

BRIEF DESCRIPTION OF THE DRAWINGS

FIG. 1 shows a preferred embodiment of the power wrench according to the invention.

DETAILED DESCRIPTION

FIG. 1 shows schematically a power wrench according to the invention and comprising a housing 10 with a rear handle 11 and a forward angle head 12. An output shaft 14 is journalled in the angle head 12 and is arranged to carry a nut socket for connection to a screw joint for tightening same. Within the housing 10, there is supported an electric rotation motor 15, a reduction gearing 16 and an override type torque release clutch 17.

Within the handle 11 there is located an electronic control unit 20 including a motor operation governing means. The control unit 20 is connected on one hand to the motor 15 and on the other hand to a power source via a supply cable 21. The latter is connected to the rear end of the handle 11 and communicates electric power from the power source, i.e. a network, to the motor 15 via the control unit 20.

At its motor end of the control unit 20 there is provided a microphone 22 utilised for detecting the characteristic release sound generated by the clutch 17. The microphone 22 delivers electric signals to the control unit 20, and the latter includes a signal identifying device which is arranged to accomplish braking of the motor 15 as soon as it recognises the very signal caused by the clutch 17 during the release movement.

Depending on the clutch design, there is generated a single or a double "click" as the torque transferring rolling elements and cam profiles of the clutch override at the pre-set target torque level. This "click" sound has a characteristic frequency and duration, and in the case of a double "click" there is a characteristic short interval between the "clicks". These identification characteristics are programmed into the signal identifying device and when there is a coincidence between the programmed data and the signals actually received from the microphone 22 the identifying device delivers an output signal to make the control unit 20 stop the motor 15. The task of the identifying device is to detect and separate the "click" sound of the release clutch from other spurious signals caused by sounds of other frequencies and duration occurring in the power wrench, for instance from the motor 15 and the reduction gearing 16.

In order to get a safer identification and separation of the clutch release "click" related signals the identifying device comprises filters for suppressing all signals related to other inadequate sounds. Sounds generated by the motor 15 and the gearing 17 are usually of a lower frequency and are easy to separate from the "click" sound related signals. Some sounds emanating from strikes on the tool housing 10 and/or on the output shaft 14 are often more alike the "click" sound. In particular, the strike sound generated when a nut socket fitted to the output shaft 14 falls down into its proper engagement with the screw head or nut under axial load at some point during the tightening process. Such nut socket fall down may occur when reaching the torque snug level of the joint and the torque resistance in the screw thread increases.

If a single "click" type clutch is used there has to be a very careful identification of the signals to safely establish whether a clutch release has actually taken place. Should a signal emanating from an external strike on the power tool be mistaken for a clutch release signal there would be generated an erroneous stop signal interrupting the tightening process at a premature stage. That would be a serious error, because the screw joint might not be tightened at all. If, however, a double "click" type of clutch is used it is much easier to separate the clutch release signal from occurring strike related signals, because in this case you can safely identify the double "click" signal.

The control unit 20 also comprises a brake sequence for accomplishing braking of the motor 15 to a quick stop as the "click" sound related signal is detected, which means that possible torque overshoots due to remaining kinetic energy in the rotating parts will be avoided.

It is to be noted that the invention is not limited to the above described example but can be freely varied within the scope of the claims. For instance the location of the microphone may be another than what is described. From the sound recording point of view it might be advantageous to locate the microphone closer to the release clutch. The technique according to the invention may be used in power wrenches of different types, for instance in power wrenches having different configurations like straight, angular and pistol handle type, mains or battery powered.

What is claimed is:

1. A method for detecting attainment of a predetermined target torque level in a screw joint tightening process performed by a power wrench having a mechanical torque responsive release clutch which is set to release at the attainment of the target torque level and which generates a characteristic release sound when releasing, said method comprising detecting the release sound generated during the release of said clutch, generating an electric signal indicative of said detected clutch release sound, and interrupting the tightening process in response to said electric signal.

2. The method according to claim 1, wherein said electric signal indicating said clutch release sound is identified by a characteristic frequency and duration and is made dominant by filtering to suppress spurious signals caused by sounds of other frequencies and duration occurring in the power wrench.

3. The method according to claim 2, wherein said clutch release sound comprises an impact sound which is indicated by at least one electric signal peak value.

4. The method according to claim 1, wherein said clutch release sound comprises an impact sound which is indicated by at least one electric signal peak value.

* * * * *